US006581549B2

(12) United States Patent
Stewart et al.

(10) Patent No.: US 6,581,549 B2
(45) Date of Patent: Jun. 24, 2003

(54) SOOTBLOWER LANCE PORT WITH LEAK RESISTANT CARDON JOINT

(75) Inventors: Michael W. Stewart, Loganville, GA (US); Jeffrey A. Atchley, Sugar Hill, GA (US)

(73) Assignee: Clyde Bergemann, Inc., Atlanta, GA (US)

( * ) Notice: Subject to any disclaimer, the term of this patent is extended or adjusted under 35 U.S.C. 154(b) by 88 days.

(21) Appl. No.: 09/944,924

(22) Filed: Aug. 31, 2001

(65) Prior Publication Data

US 2002/0040691 A1 Apr. 11, 2002

Related U.S. Application Data

(60) Provisional application No. 60/229,215, filed on Aug. 31, 2000.

(51) Int. Cl.[7] ..... F28G 3/00

(52) U.S. Cl. ..... 122/379; 122/390; 122/392; 134/167 R; 15/316.1

(58) Field of Search ..... 122/379, 390, 122/392; 134/167 R, 172, 198; 15/316.1

(56) References Cited

U.S. PATENT DOCUMENTS

| | | | | | |
|---|---|---|---|---|---|
| 1,571,038 | A | * | 1/1926 | Bayer | 122/392 |
| 2,972,502 | A | * | 2/1961 | Jennings et al. | 15/95 |
| 3,111,701 | A | | 11/1963 | Cantieri | 15/317 |
| 3,230,568 | A | | 1/1966 | Saltz | 15/317 |
| 3,344,459 | A | | 10/1967 | Jankowski | 15/317 |
| 3,816,871 | A | | 6/1974 | Karnofsky | 15/317 |
| 4,565,324 | A | | 1/1986 | Rebula et al. | 239/290 |
| 4,580,310 | A | | 4/1986 | Zalewski | 15/316 |
| RE32,517 | E | | 10/1987 | Nelson | 122/379 |
| 4,905,900 | A | | 3/1990 | Scharton et al. | 239/99 |
| 5,063,632 | A | | 11/1991 | Clarke et al. | 15/316.1 |
| 5,097,564 | A | | 3/1992 | Billings | 15/316.1 |
| 5,277,153 | A | | 1/1994 | Kakabaker | 122/390 |
| 5,286,063 | A | * | 2/1994 | Huston | 285/11 |
| 5,494,004 | A | | 2/1996 | Hunter, Jr. | 122/395 |
| 5,503,115 | A | | 4/1996 | Franzke et al. | 122/390 |
| 5,549,305 | A | | 8/1996 | Freund | 277/106 |
| 5,560,323 | A | | 10/1996 | Billings | 122/379 |
| 5,605,117 | A | | 2/1997 | Moskal | 122/379 |
| 5,745,950 | A | | 5/1998 | Holden et al. | 15/316.1 |
| 5,823,209 | A | * | 10/1998 | Kleye et al. | 134/57 R |
| 5,882,430 | A | | 3/1999 | Kleye et al. | 134/18 |
| 6,164,956 | A | | 12/2000 | Payne et al. | 431/3 |
| 6,283,069 | B1 | | 9/2001 | Bude et al. | 122/379 |
| 6,290,778 | B1 | | 9/2001 | Zugibe | 134/1 |

FOREIGN PATENT DOCUMENTS

| | | |
|---|---|---|
| DE | 145476 | 12/1980 |

* cited by examiner

*Primary Examiner*—Jiping Lu
(74) *Attorney, Agent, or Firm*—Womble Carlyle Sandridge & Rice, PLLC

(57) ABSTRACT

A cardon joint is provided for mounting in a wall of a boiler to accommodate a sootblower lance and to allow the lance to be manipulated with respect to the boiler wall. The cardon joint includes a wall box having a central opening. An outer ball having a substantially spherical outer surface and a central bore is mounted for axial rotation about a first axis within the central opening of the wall box. An inner ball having a substantially spherical outer surface and a central bore is mounted for axial rotation about a second axis within the central bore of the outer ball. The first and second axes are mutually orthogonal and the central bore of the inner ball is sized to accommodate the lance of a sootblower. As the lance is manipulated to clean an opposite wall of the boiler, the inner and outer balls rotate about their axes to accommodate the manipulation. Substantially constant gaps are maintained between the outer ball and the wall box and between the inner ball and the outer ball to provide a controlled constant flow of seal air through the gaps.

17 Claims, 5 Drawing Sheets

SOOTBLOWER LANCE PORT WITH LEAK RESISTANT CARDON JOINT

REFERENCE TO RELATED APPLICATION

The benefit of the filing date of U.S. Provisional patent application serial No. 60/229,215 filed on Aug. 31, 2000 is hereby claimed.

TECHNICAL FIELD

The present invention relates generally to sootblowers for removing combustion residues from interior surfaces of a boiler furnace and more specifically to ports through which a sootblower lance penetrates the wall of a boiler.

BACKGROUND

The accumulation of fireside deposits on the internal heating surfaces of boiler furnaces drastically reduces their thermal efficiency and, if not removed, requires periodic shutdowns of the boiler for manual cleaning. The principal means of removing fireside deposit accumulations in boiler furnaces is through the use of a cleaning device known as a sootblower. In general, a sootblower includes an elongated hollow lance that is inserted through a wall of a boiler furnace to position the end of the lance adjacent internal surfaces to be cleaned. The end of the lance is provided with a head having specialized nozzles. Compressed air or steam may be forced under pressure through the lance so that it is ejected at high velocity through the nozzles and against internal surfaces to dislodge and clean away combustion deposits. One major advantage of cleaning a boiler furnace with a sootblower is that the boiler does not need to be shut down in order to accomplish the cleaning because cleaning is carried out while the boiler is in operation.

In some cases, steam or compressed air may prove to be insufficient to remove tenacious combustion residues from interior surfaces of a boiler furnace and in these cases, water jet sootblowers have proven successful. A water jet sootblower has a head provided with nozzles that are specially designed to create a tightly collimated stream or jet of high velocity water when fed with water under pressure through the lance. The water jet or jets issuing from these nozzles impacts and penetrates the layers of residue on interior surfaces of the boiler. Expansion of this water as it is converted to steam within the residue produces pressure, which causes the residue to fracture and debond from the surfaces so that it can be cleaned away more easily.

One method of cleaning the internal or fire side surfaces of a boiler wall with a water jet sootblower is to fit two nozzles on a lance tube in such a manner that the water jets emerging from these nozzles are directed back to the boiler wall through which the lance tube extends. As the lance tube is rotated and advanced further into the boiler, the water jets impact and scribe a spiral pattern on the wall, dislodging and cleaning away tenacious combustion deposits such as slag. In another configuration designed to clean the boiler wall opposite to the wall through which a lance extends, a so called water cannon may be used. A water cannon refers to a sootblower wherein the lance tube is fitted with a head that directs a high velocity collimated jet or jets of water substantially axially from the end of the lance. The lance is inserted through a wall of the boiler opposite to the wall that is to be cleaned. Water is then supplied through the lance at high pressure and the resulting water jets are directed toward, impinge upon, and remove deposits from the opposite wall.

When using a water cannon to clean the opposite wall of a boiler, it is desirable to be able to manipulate the lance in order to move the head around to clean a large area of the opposite wall. To provide for such manipulation, cardon joints have been used at the location where the lance tube tip penetrates the boiler wall. FIGS. 1 and 2, annexed hereto, illustrate a traditional cardon joint and show a water cannon lance mounted within a cardon joint installed in a boiler wall. In general, a traditional cardon joint is made up of two concentrically disposed rings mounted in a wall box that, in turn, is mounted in a wall of the boiler. The rings are pivotally mounted within the wall box on orthogonal axes, referred to as the X-axis and the Y-axis, the inner ring being pivotally mounted within the outer ring and the outer ring being pivotally mounted within the wall box. This configuration provides freedom to point the nozzle of a water canon secured within the inner ring in any direction as the concentric rings rotate about the X and Y axes, as illustrated by the arrows in FIG. 1.

Referring to FIGS. 2 and 3, which illustrate a prior art cardon joint, the joint assembly is mounted in a wall of a boiler furnace with one side facing the fireside of the boiler and the other side facing the outside of the boiler. In use, a lance tube is mounted and secured in the opening of the central ring of the cardon joint. When the lance is in its normal rest orientation perpendicular to the wall of the boiler, the rings of the cardon joint align and are substantially coplanar with respect to each other as shown in FIG. 2. In such a configuration, the gaps between the inner ring and the outer ring and between the outer ring and the frame of the wall box are at a minimum. If the boiler furnace has a negative pressure with respect to the outside atmosphere, which is normal, then a small amount of air is drawn through these gaps and this acts as a seal and an insulator against the extreme heat within the boiler. However, in the event that the boiler furnace should develop a positive internal pressure, hot boiler gases with temperatures in excess of 2000 degrees Fahrenheit can pass outwardly through the gaps, which heats the cardon joint and ultimately can result in its destruction and failure.

This situation is exacerbated when a water canon is being used with a cardon joint in the normal way by manipulating the cannon lance up and down and around. Under these circumstances the concentric rings of a traditional cardon joint are not aligned and coplanar but instead become cocked or skewed with respect to one another and with respect to the wall box frame as shown in FIG. 3. Obviously, under these conditions, the gaps between the rings and between the outer ring and the frame are much larger and, at the extreme X–Y position of the lance, are maximized. Here, escape of hot boiler gasses under conditions of positive furnace pressures is significantly more prevalent and can result in a host of undesirable consequences. In addition, even under negative furnace pressures, it is more difficult to maintain the insulating seal that results from a draft of outside air through the gaps of the cardon joint when the gaps are large.

Some boilers intentionally are built to operate with a positive draft, i.e. positive furnace pressures. In these instances, the interior of the boiler is always at a higher pressure than the surrounding atmosphere and hot boiler gasses can escape through the gaps of the cardon joint. In order to mitigate the consequences of this, air at a pressure higher than that within the boiler is applied to the outside of the cardon joint to maintain a positive pressure differential and prevent the escape of hot boiler gases. A common way of achieving this is to fit a flexible fabric-like plenum around the cardon joint and pressurize the plenum to maintain a positive pressure on the joint. Such an arrangement is illustrated in FIG. 4. The sootblower or water cannon lance extends through an opening in the fabric plenum and through the cardon joint and can be manipulated in the usual way, the plenum flexing as needed to permit manipulation of the lance.

Field experience has shown that the heat and constant flexing of the fabric plenum during use leads to failure of the plenum material. The failure point usually is close to the opening in the plenum through which the lance extends as illustrated in FIG. 4. This is the area of the plenum where the fabric experiences the tightest bend radii and undergoes the most stress. Failure of the plenum material allows some of the pressurized gas within the plenum to escape, resulting in the requirement of larger and larger amounts of seal air to maintain plenum pressure during operation. As the failure worsens, it can become impossible to maintain a positive pressure differential between the inside of the plenum and the inside of the boiler. This is particularly true when the lance is oriented at acute angles relative to the boiler wall because of the large gaps that are formed through the cardon joint under these conditions and the resulting large air flows. When the pressure within the plenum falls below the boiler pressure, hot boiler gasses escape through the cardon joint, with numerous undesirable and perhaps disastrous results. Thus, prior art cardon joints and related components and systems, even when supplied with exterior pressurized plenums, have proven to be a less than adequate solution to the need for a manipulatable water canon for cleaning the fireside walls of a boiler.

Therefore, a need exists for a cardon-type joint for use in sootblower applications that successfully addresses the problems and shortcomings of the prior art as discussed above. It is to the provision of such a joint that the present invention is primarily directed.

SUMMARY OF THE INVENTION

Briefly described, the present invention, in a preferred embodiment thereof, comprises an improved cardon joint for use in sootblower applications, and especially water cannon applications that eliminates the problems and shortcomings of the prior art. The cardon joint comprises an outer frame or wall box configured to be fitted in a selected wall of a boiler furnace to support the operative elements of the joint. The frame has a generally circular central opening. An outer ball is formed with a generally spherically shaped outer surface and is provided with a central bore extending therethrough. A pair of diametrically opposed radially extending pivot pins project from the surface of the outer ball and are journaled within corresponding diametrically opposed pivot pin sockets formed in the interior edge of the central opening of the wall box. With this configuration, the outer ball is free to rotate on its axis within the opening of the wall box.

An inner ball having a generally spherical outer surface and a central bore is sized to be received within the central bore of the outer ball. The central bore of the inner ball is sized to receive the lance of a sootblower or water cannon. The inner ball is provided with a pair of diametrically opposed pivot pins projecting from its surface and these pivot pins are journaled within corresponding diametrically opposed pivot pin sockets formed in the surface of the central bore of the outer ball. The pivot pins of the inner ball preferably are oriented orthogonally with respect to the pivot pins of the outer ball. In this way, the inner ball is free to pivot about a first axis while the outer ball is free to pivot about a second axis perpendicular to the first axis.

In use, the lance of a water canon is mounted in the central bore of the inner ball to position the head of the water cannon such that it is directed generally toward an opposite boiler wall to be cleaned. The lance and thus the head of the water cannon can be moved about as needed by manipulating the lance within the cardon joint. As the lance is manipulated, the inner ball of the cardon joint rotates within the central bore of the outer ball and the outer ball rotates within the central opening of the wall box as necessary to accommodate movement of the lance. However, unlike prior art cardon joints, the gap between the inner ball and the outer ball and the gap between the outer ball and the wall box remains constant and at a predetermined minimum regardless of the orientation of the lance. Since the size of the balls and the central opening can be carefully controlled through tight manufacturing processes to form arbitrarily small gaps, the escape of hot boiler gasses through the gaps can be controlled and a substantially constant flow of seal air, determined by the size of the gaps, is maintained for all orientations of the lance. When used with positive draft furnaces and pressure plenums or other means and mechanisms for maintaining a positive pressure differential between the outside and inside of the joint, a minimum amount of seal air is required to maintain a seal because the gaps through the cardon joint are always small. Accordingly, since hot boiler gases do not escape into the plenum, instances of plenum failure are greatly reduced. Thus, prior art problems with insufficient pressure to maintain a seal are reduced significantly.

In one embodiment, a seal air plenum is formed in the wall box structure and the seal air plenum communicates with the gap between the outer ball and the central opening. Generally radially extending seal air ports are formed in the outer ball. These seal air ports communicate between the seal air plenum and the central bore of the outer ball in a region adjacent the gap between the inner ball and the wall of the central bore of the inner ball. With such a construction, seal air from the plenum feeds both the gap between the outer ball and the opening in which it is mounted and the gap between the inner ball and the central bore of the outer ball in which the inner ball is mounted. Seal air can be provided to the seal air plenum through an appropriate inlet port to maintain a constant inward flow of seal air through the gaps for sealing and cooling.

Thus, an improved cardon joint for water cannon applications is now provided that successfully addresses the problems and shortcoming of the prior art. These and other features, objects, and advantages of the invention will become more apparent upon review of the detailed description set forth below when taken in conjunction with the accompanying drawing figures, which are briefly described as follows.

DETAILED DESCRIPTION OF THE PREFERRED EMBODIMENTS

Figure 1:
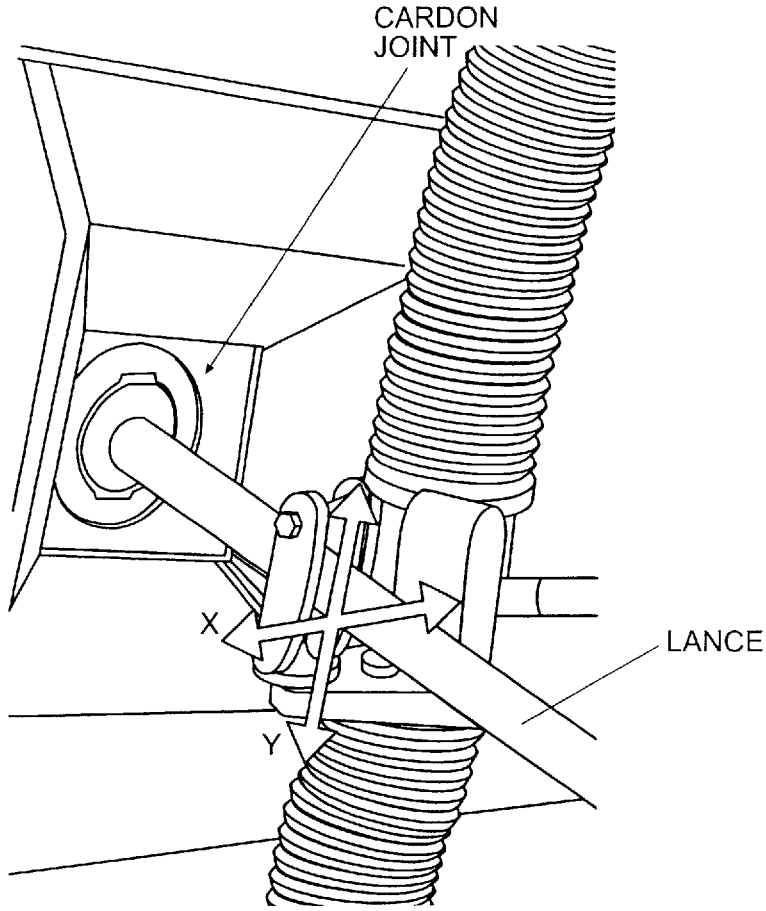
(Prior Art) Fig. 1
FIG. 1 is a perspective view of a typical prior art cardon joint through which the lance of a sootblower is seen to extend.
Figure 2:
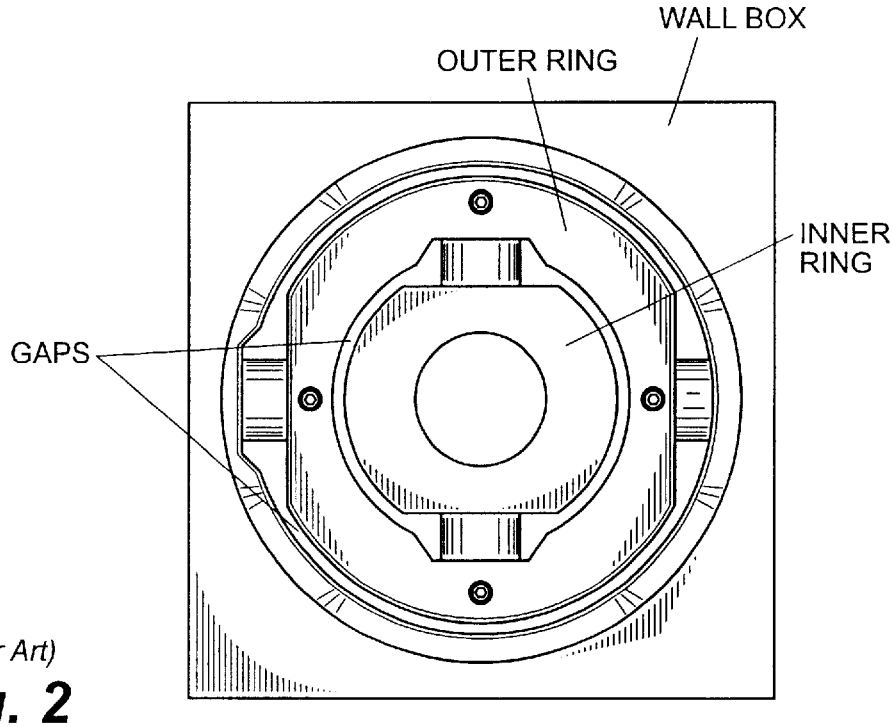
(Prior Art) Fig. 2
FIG. 2 is a plan view of a typical prior art cardon joint for sootblower applications.
Figure 3:
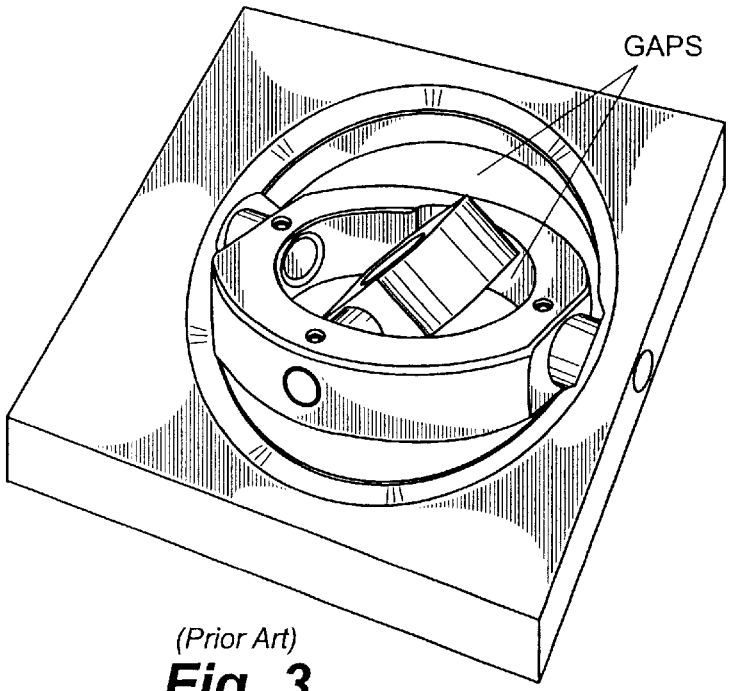
(Prior Art) Fig. 3
FIG. 3 is a perspective view of the prior art cardon joint of FIG. 2 illustrating the large gaps formed when the joint is configured to accommodate lance manipulation.
Figure 4:
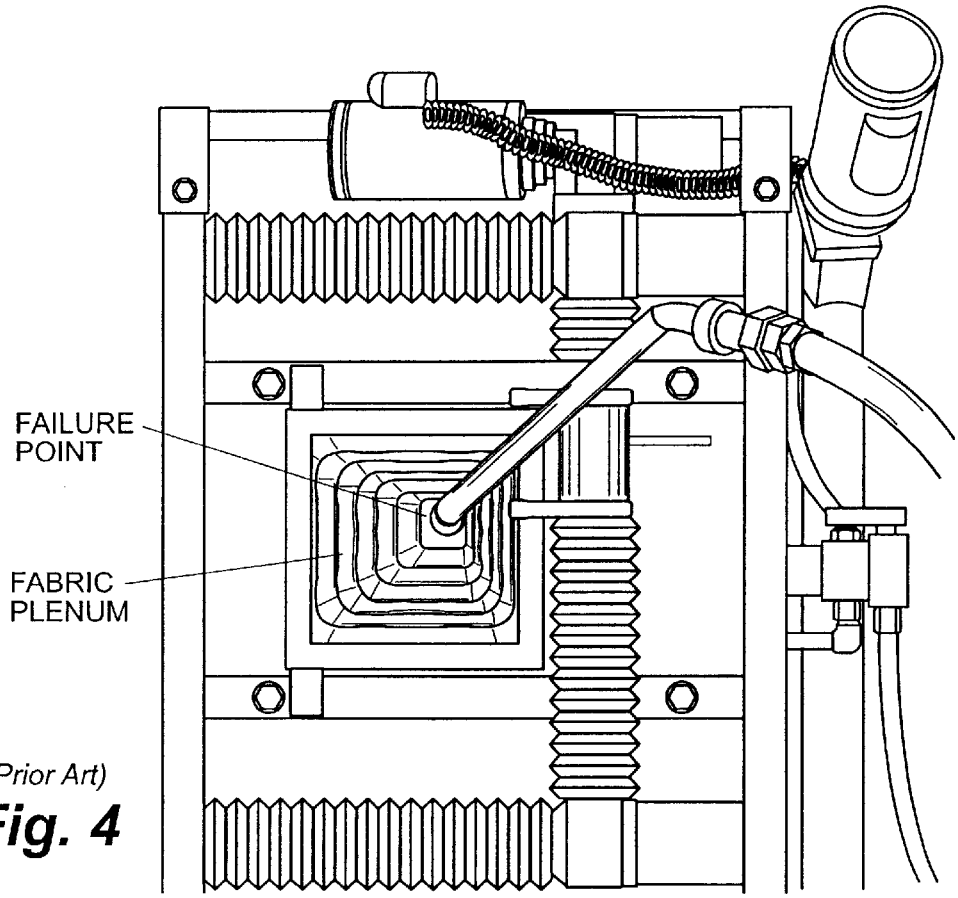
(Prior Art) Fig. 4
FIG. 4 is a plan view of a prior art cardon joint assembly for use with a positive draft furnace showing a fabric plenum surrounding the cardon joint for maintaining positive pressure thereon.

Reference will now be made in more detail to the drawings of FIGS. 5 through 7 (FIGS. 1 through 4, which illustrate prior art, have been discussed previously in the background section hereof). A cardon joint assembly 11 according to the present invention is fitted in a selected wall of a boiler furnace to provide sootblower and particularly water cannon access to the interior of the boiler. The assembly 11 comprises a wall box 12 that is secured within a wall of the boiler and that is formed with a generally circular central opening 14. Auxiliary plates 13 are added to the traditional wall box and a mounting assembly 61 (FIG. 7) is disposed behind the auxiliary plates to improve the sealability of the cardon joint and to facilitate an improved means of providing seal air to the joint, as discussed in more detail below. An outer ball 15, which, preferably, is formed of a heat and corrosion resistant material such as metal or ceramics, has a generally spherical outer surface 16 and is disposed in the central opening 14 of the wall box 12 as shown. The diameter of the spherical surface 16 of the outer ball 15 is predetermined such that a relatively small gap 24 is defined between the central opening 14 and the surface 16 of the outer ball.

Figure 5:
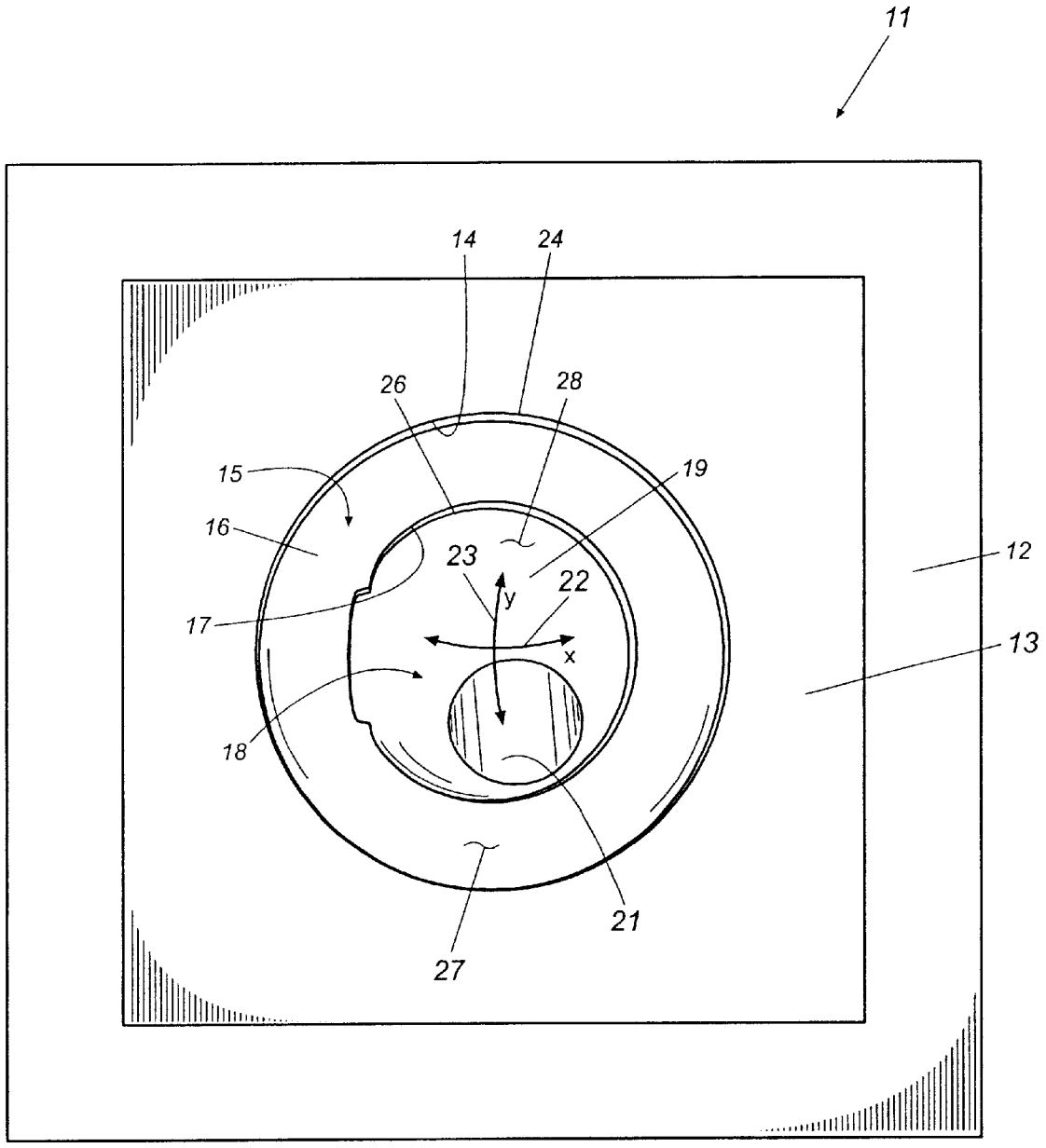
FIG. 5 is a plan view of a novel cardon joint for sootblower applications that embodies principles of the present invention in a preferred form.
Figure 6:
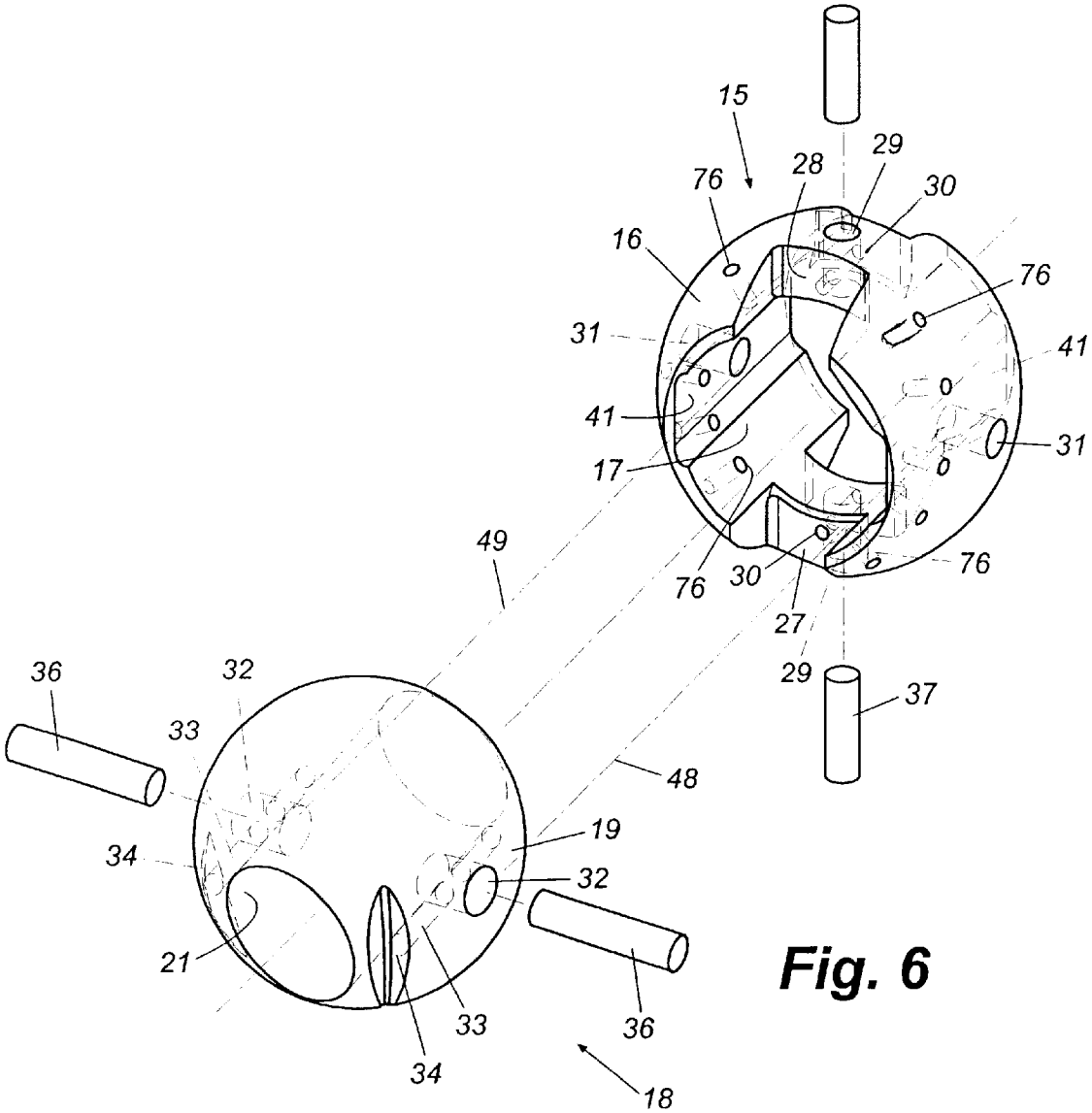
FIG. 6 is a perspective exploded view illustrating the outer ball and the inner ball of the cardon joint of this invention.

As best seen in FIG. 6, the outer ball 15 is fitted with a pair diametrically opposed radially projecting pivot pins 37. These pivot pins are rotatably journaled within pivot pin sockets 66 formed in the peripheral edges of an annular mounting ring 62 that forms a part of the mounting block assembly 61 (see FIG. 7). With this configuration, the outer ball is free to rotate within the annular mounting ring 62 and within the central opening 14 in a horizontal direction about a first axis extending through its pivot pins, i.e. in the X-direction as indicated by the ordinate 22 in FIG. 5. Significantly, as the outer ball rotates, the gap 24 between its outer surface 16 and the central opening 14 and the gap 71 between the outer ball and the mounting ring 62 (FIG. 7) remain constant and small as a result of the spherical shape of the outer surface and the axial orientation of the pivot pins 37.

The outer ball 15 is formed with a generally cylindrical central bore 17 that extends through the outer ball as shown. An inner ball 18 has a generally spherical outer surface 19 and is mounted within the central bore 17 of the outer ball 15 as illustrated in FIG. 5. The diameter of the inner ball is selected so that a relatively small gap 26 is formed between the outer surface 19 of the inner ball and the central bore 17 of the outer ball. A pair of diametrically opposed pivot pins 36 (FIG. 6) project from the surface of the inner ball and are journaled within pivot pin sockets 31 formed in the walls of the outer ball central bore. Recesses 34 and locking pin holes 33 are provided for adjusting and locking the pivot pins 36 within their respective pivot pin holes 32 with a locking pin (not shown). The pivot pin sockets 31 are located at diametrically opposed positions within the outer ball to receive the pivot pins 36 of the inner ball and are oriented along a second axis, which, in the illustrated embodiment, is a horizontal axis. Thus, the pivot pins 36 of the inner ball are oriented orthogonally relative to the pivot pins 37 of the outer ball.

An array of generally radially extending (relatively to the central bore of the outer ball) seal air ports 76 are formed in the outer ball 15 and each port communicates between the outside surface of the outer ball and the central bore thereof. As discussed in more detail below, these ports are positioned to deliver seal air to the gap 26 between the inner ball and the wall of the central bore 17 of the outer ball.

With this configuration, the inner ball 18 may pivot within the outer ball in a vertical direction or along the Y-axis 23 in FIG. 5. Slots or indented regions 41 may be formed in the inner wall of the outer ball at the location of the pivot sockets 31 if desired. It will be appreciated that while the preferred embodiment illustrates the outer ball pivoting about a horizontal X-axis and the inner ball pivoting about a vertical Y-axis, this is not a requirement or limitation of the invention. Other axes may be selected if desired. Regardless of the direction of the axes, preferably, but not necessarily, they are mutually orthogonal with respect to each other to allow full freedom of motion of the lance.

The inner ball 18 is formed with a central bore 21 that extends through the inner ball and, in operation, communicates between the outside of a boiler and the inside or fire side thereof. The central bore 21 is sized to receive and securely hold the lance of a water cannon mounted therein, as best illustrated in FIG. 7.

Figure 7:
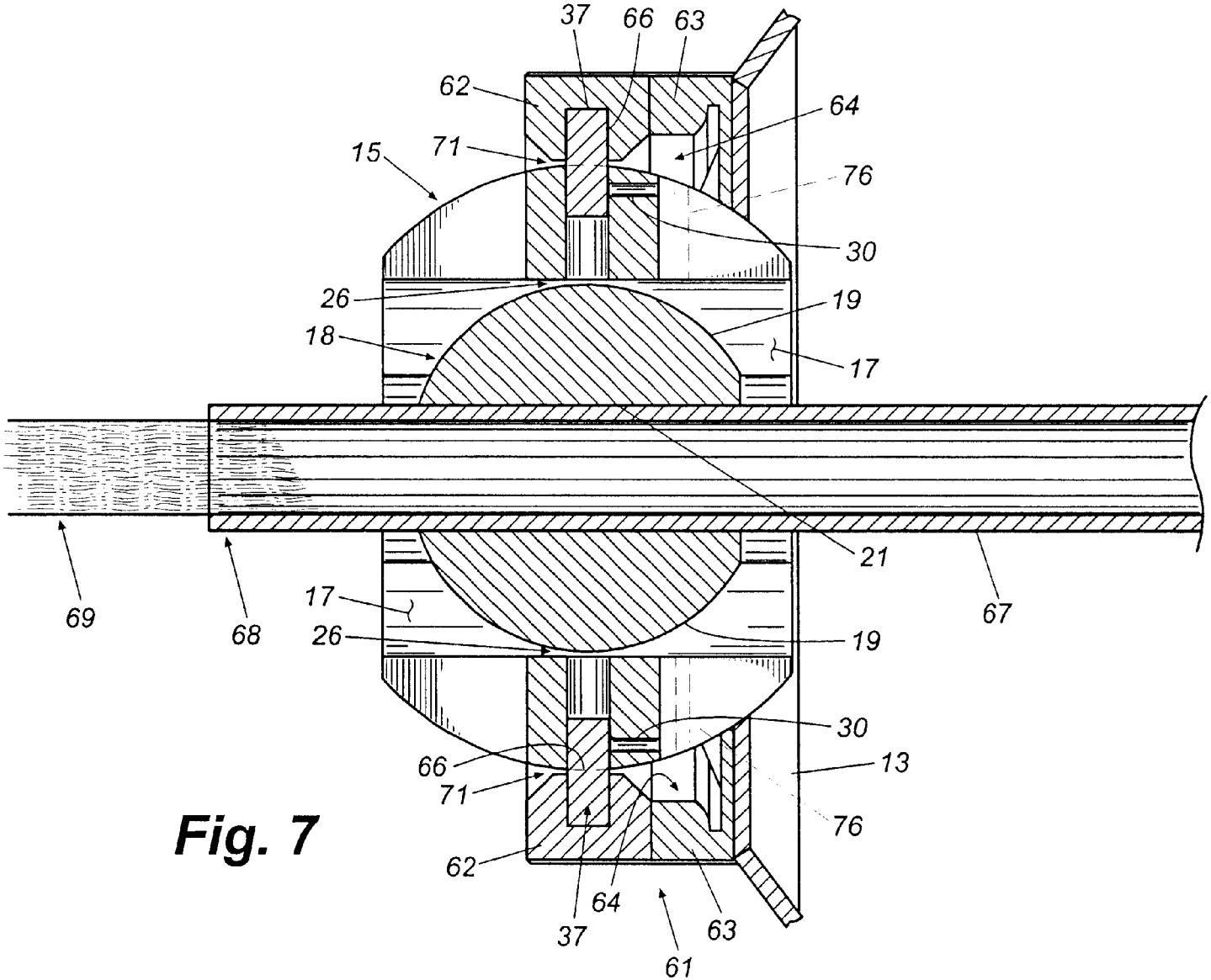
FIG. 7 is a cross-sectional view of a cardon joint according to the invention showing the inner and outer balls of the joint mounted within the mounting block assembly with a water cannon lance secured in the inner ball.

FIG. 7 is a cross-sectional illustration of the cardon joint assembly of the invention illustrating details of the mounting block assembly, including the internal seal air chamber or plenum thereof. A mounting block assembly 61 is disposed on the inside or fire side of the wall box 13. The mounting block assembly 61 includes a generally annular mounting ring 62 having an axially curved or concave inner surface with a radius of curvature that sibstantially corresponds to that of the outer ball 15. A plenum ring 63 is disposed between the mounting ring 62 and the wall box 13 and, in conjunction with the mounting ring, defines a roughly ring-shaped plenum chamber 64 that extends around the outer ball 15. As discussed briefly above, the outer ball 15 of the cardon joint is pivotally mounted within the mounting ring 62 by means of pivot pins 37 that project in diametrically opposed directions from the outer ball and that are rotatably journaled within pivot pin sockets 66 formed in the mounting ring. It thus will be seen that the outer ball 15 is free to pivot or rotate about an axis that extends through the pivot pins 37. Further, the mounting ring 62 is formed so that its inner diameter is slightly larger than the diameter of the outer ball 15. In this way, a relatively small gap 71 is defined between the surface of the outer ball and the mounting ring 62, as shown.

The inner ball 19 of the cardon joint is pivotally mounted within the central bore 17 of the outer ball 15. As discussed in some detail with respect to FIG. 6, the inner ball 19 is mounted by means of pivot pins 36 and pivot pin sockets 31 for rotation within the outer ball about an axis that preferably is orthogonally oriented with respect to the axis of rotation of the outer ball 15. As depicted in FIG. 7, therefore, the inner ball 19 rotates or pivots about an axis that extends into the drawing page. A water cannon lance 67 having a nozzle end 68 is secured within the central bore 21 of the inner ball. The nozzle end 68 of the water cannon lance is thus pointed generally toward the wall of the boiler opposite to the wall in which the cardon joint assembly is mounted. In this way, high velocity jets of water 69 may be directed to the opposite wall to clean fireside deposits therefrom. During the process, the water cannon may be manipulated in any direction within the cardon joint as necessary to clean the entire surface of the opposite wall. In this regard, automated mechanisms coupled to the lance often are implemented to control the manipulation of the lance to insure efficient cleaning.

As discussed above, it is desirable during operation of the water cannon to provide a constant inward flow of seal air through gaps in the cardon joint to cool the joint and prevent blow-out of hot combustion gases. With the present invention, this can be accomplished at least partially by supplying seal air to the seal air plenum 64 at a pressure greater than the interior pressure of the boiler. This establishes a seal air flow through the annular gap 71 between the outer ball 15 and the mounting ring 62. Unlike prior art cardon joints, this gap remains constant and small for all orientations of the outer ball. Accordingly, the volume of seal air required to maintain a constant inward flow of seal air also is constant. The sealing and insulating properties of the flow is thus constant and reliable. To provide a constant flow of seal air through the gap between the inner ball and the outer ball, an array of seal air ports 76 are formed through the outer ball 15. The seal air ports extend in generally radial directions relative to the central bore 17 of the outer ball. Each seal air port 76 communicates between the seal air plenum 64 and the central bore 17 of the outer ball in a region adjacent to the gap 26 between the inner ball 18 and the wall of the central bore 17. Thus, seal air is delivered from the seal air plenum 64 to the gap 26 through the seal air ports 76. When used with a negative pressure boiler where the pressure within the boiler is less than ambient pressure, this seal air and seal air from the surrounding atmosphere is drawn naturally through the gap 26 to provide a seal and cooling. Again, since the gap between the inner ball 18 and the central opening 17 of the outer ball is constant and relatively small for all orientations of the inner ball, the volume of seal air and thus the pressure within the plenum 64 required to maintain a constant inward flow of seal air through the gaps remains constant and relatively small.

In operation during the cleaning of an opposite wall of a boiler, the cardon joint assembly of the present invention is installed in the wall of the boiler opposite to the wall to be cleaned as illustrated in FIG. 5 with the lance 67 (FIG. 7) of a water cannon securely mounted in the central bore 21 of the inner ball. The head 68 of the water cannon is thus pointed generally toward the opposing wall of the boiler, which is to be cleaned. High pressure water is supplied as described above and is ejected as a jet or jets against the opposite wall. The lance may then be manipulated as needed to move and point the water cannon head about in the X and Y directions to cover and clean a large area of the surface of the opposite wall of the boiler.

During manipulation of the lance, the inner ball of the cardon joint pivots or rotates about the Y-axis within the outer ball and the outer ball rotates or pivots about the X-axis within the mounting block assembly, allowing complete freedom of movement of the lance. However, unlike prior art cardon joints, regardless of the orientation of the lance and the corresponding relative positions of the inner and outer balls, the gaps formed between the outer ball and its mounting ring and between the inner ball and the outer ball remain constant and preferably relatively small. Thus, air flow through these gaps remains constant. The sizes of the balls can be predetermined to result in any desired air flow rate appropriate to form an optimum air seal and to provide optimum cooling. In the event that a positive pressure should develop with the furnace, the seal air, which may be supplied by means of a traditional plenum arrangement or, in the preferred embodiment, by pressurizing the seal gas plenum within the mounting block assembly, prevents the hot gasses from escaping through the gaps thereby minimized the danger of these gasses degrading or destroying the cardon joint and surrounding structures. In the event of a positive draft furnace where a pressurized fabric-like plenum may enclose the cardon joint to maintain a positive pressure on the outside of the joint, a predetermined, constant, and relative small air flow is established through the gaps of the cardon joint at all positions of the lance. Thus, positive pressure can be maintained because the large air flows through the cardon joint prevalent in prior art joints, especially when the lance is at a skewed orientation, do not develop with the joint of the present invention.

The invention has been described herein in terms of preferred embodiments and methodologies. It will be appreciated by those of skill in the art, however, that a wide variety of modifications and equivalent substitutions may be made to the illustrated embodiments within the scope of the invention. For instance, while mutually orthogonal axes of rotation are preferable for the inner and outer balls, other axes may be selected if desired to suit specific lance manipulation needs. The materials from which the inner and outer balls and the wall box are fabricated may be any suitable metal or even some ceramic coated materials, as long as they are able to withstand the high temperatures to which they will be exposed on the fire side of the joint. These and other additions, deletions, and modifications of the preferred embodiments illustrated herein may well be made by those of skill in the art without departing from the spirit and scope of the invention as set forth in the claims.

What is claimed is:

1. A cardon joint for mounting in a wall of a boiler to support a sootblower lance and to allow manipulation of the sootblower lance, said cardon joint comprising:

a mounting block assembly having a central opening;

an outer ball having a central bore, said outer ball being mounted within said central opening of said mounting block assembly for rotation about a first axis;

an inner ball having a central bore, said inner ball being mounted within said central bore of said outer ball for rotation about a second axis;

said central bore of said inner ball being sized to receive and hold a sootblower lance, rotation of said outer and inner balls about their respective axes accommodating manipulation of said sootblower lance.

2. A cardon joint as claimed in claim 1 and wherein said first axis and said second axis are mutually orthogonal.

3. A cardon joint as claimed in claim 1 and wherein a first gap is defined between said outer ball and said central opening of said mounting block assembly and wherein said outer ball has an outer surface that is substantially spherical to maintain the size of said first gap as said outer ball rotates within said central opening.

4. A cardon joint as claimed in claim 3 and wherein a second gap is defined between said inner ball and said outer ball and wherein said inner ball has an outer surface that is substantially spherical to maintain the size of said second gap as said inner ball rotates within said outer ball.

5. A cardon joint as claimed in claim 1 and wherein a first gap is defined around said outer ball within said central opening of said mounting block assembly and wherein said mounting block assembly further defines a seal air plenum communicating with said first gap, said seal air plenum being adapted to receive seal air to maintain a flow of seal air through said first gap.

6. A cardon joint as claimed in claim 5 and wherein a second gap is defined around said inner ball within said central bore of said outer ball for accommodating a flow of seal air therethrough, and further comprising at least one seal air port formed in said outer ball communicating between said seal air plenum and said central port of said outer ball in the region of said second gap for providing seal air to said second gap from said seal air plenum.

7. A boiler comprising:

boiler walls;

a cardon joint assembly mounted in a selected wall of said boiler for accommodating and allowing manipulation of a sootblower lance;

said cardon joint assembly having an outer ball mounted within an central opening, said outer ball having a substantially spherical outer surface and a central bore, and an inner ball mounted in said central bore of said outer ball and having a central bore sized to accommodate the sootblower lance;

said outer ball being rotatable within said opening about a first axis and said inner ball being rotatable within said inner ball about a second axis to accommodate manipulation of the sootblower lance.

8. A boiler as claimed in claim 7 and wherein a first gap is defined between said outer ball and said central opening and a second gap is defined between said inner ball and said outer ball, said first and second gaps remaining relatively constant as said inner and outer balls rotate about their respective axes.

9. A boiler as claimed in claim 8 and wherein said first axis and said second axis are mutually orthogonal.

10. A boiler as claimed in claim 8 and further comprising a seal air plenum surrounding said outer ball and communicating with said first gap, said seal air plenum for receiving pressurized seal air to maintain a flow of seal air through said first gap.

11. A cardon joint assembly for mounting in a wall of a boiler to accommodate a sootblower lance extending through said cardon joint, said cardon joint assembly comprising a mounting block assembly having a central opening, an outer ball having a substantially spherical outer surface and a central bore, said outer ball being mounted for axial rotation about a first axis within said central opening, and an inner ball having a substantially spherical outer surface and a central bore, said inner ball being mounted for axial rotation about a second axis within said central bore of said outer ball, said central bore of said inner ball being sized to receive a sootblower lance and said rotatable inner and outer balls rotating about their respective axes to accommodate selective manipulation of said sootblower lance relative to the boiler wall.

12. A cardon joint as claimed in claim 11 and wherein said first axis and said second axis are mutually orthogonal.

13. A cardon joint as claimed in claim 12 and wherein said outer ball is mounted in said central opening with diametrically opposed pivot pins and said inner ball is mounted within said central bore of said outer ball with diametrically opposed pivot pins.

14. A cardon joint as claimed in claim 11 and wherein a first gap is defined between said outer ball and said mounting block assembly and wherein said mounting block assembly further defines a seal air plenum communicating with said first gap for receiving pressurized seal air to maintain a flow of seal air through said first gap.

15. A cardon joint as claimed in claim 14 and wherein a second gap is defined around said inner ball within said central bore of said outer ball for accommodating a flow of seal air therethrough, and further comprising at least one seal air port formed in said outer ball communicating between said seal air plenum and said central port of said outer ball in the region of said second gap for providing seal air to said second gap from said seal air plenum.

16. A cardon joint assembly for mounting in a selected wall of a boiler to accommodate and permit selective manipulation of a sootblower lance extending through the boiler wall, said cardon joint assembly comprising a mounting block defining a generally circular central opening bounded by an opening wall, a generally spherical outer ball having a central bore, said outer ball being mounted within said central opening for rotation therein about a first axis with a first gap being formed between said outer ball and said opening wall, a generally spherical inner ball having a central bore for receiving a sootblower lance, said inner ball being mounted within said central bore of said outer ball for rotation therein about a second axis different from said first axis, a second gap being formed between said inner ball and said outer ball, the size of said first and second gaps remaining substantially constant as said inner and said outer balls rotate about their respective axes during manipulation of the sootblower lance.

17. A cardon joint assembly as claimed in claim 16 and further comprising a seal air plenum formed in said mounting block and communicating with said first gap, said seal air plenum for receiving seal air to establish a flow of seal air through said first gap.

* * * * *